United States Patent [19]

Lincke

[11] Patent Number: 4,513,792

[45] Date of Patent: Apr. 30, 1985

[54] WEFT YARN TENSIONING DEVICE

[75] Inventor: Paul Lincke, Zell, Switzerland

[73] Assignee: Sulzer Brothers Limited, Winterthur, Switzerland

[21] Appl. No.: 482,243

[22] Filed: Apr. 5, 1983

[30] Foreign Application Priority Data

Apr. 7, 1982 [CH] Switzerland ..... 2145/82

[51] Int. Cl.[3] ..... D03D 47/25; D03D 47/34

[52] U.S. Cl. ..... 139/439; 139/450; 139/453

[58] Field of Search ..... 139/429, 439, 450, 453, 139/452; 66/125

[56] References Cited

U.S. PATENT DOCUMENTS

| | | | |
|---|---|---|---|
| 3,315,708 | 4/1967 | Scheffel | 139/453 |
| 3,340,903 | 9/1967 | Golobart | 139/450 |
| 4,114,658 | 9/1978 | Turbin | 139/452 |

FOREIGN PATENT DOCUMENTS

| | | | |
|---|---|---|---|
| 2104112 | 1/1983 | United Kingdom | 139/450 |
| 243506 | 9/1969 | U.S.S.R. | 139/453 |
| 720069 | 3/1980 | U.S.S.R. | 139/435 |

*Primary Examiner*—Henry S. Jaudon

*Attorney, Agent, or Firm*—Kenyon & Kenyon

[57] ABSTRACT

The weft yarn tensioning device is employed in a weft changing operation for a weaving machine. The tensioning device has a rod which oscillates at the cadence of the weaving machine transversely of the weft yarn group. The rod deflects the yarns to retaining elements which hold the deflected yarns during upward movement of the rod. A control device is provided for the retaining elements whereby the weft yarn which is to be picked can be released during the upward movement of the rod. The retaining elements can be electromagnetically operated or mechanically operated.

10 Claims, 12 Drawing Figures

Fig. 2
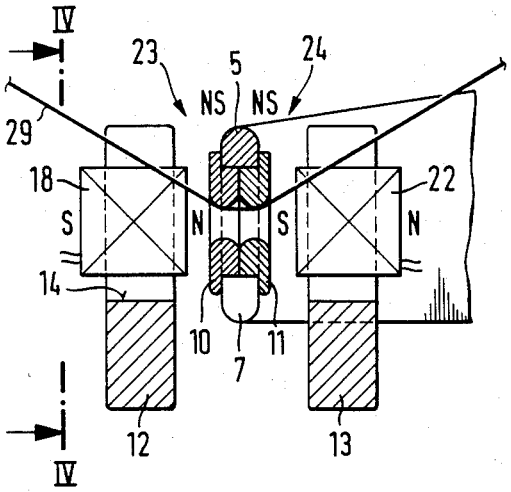
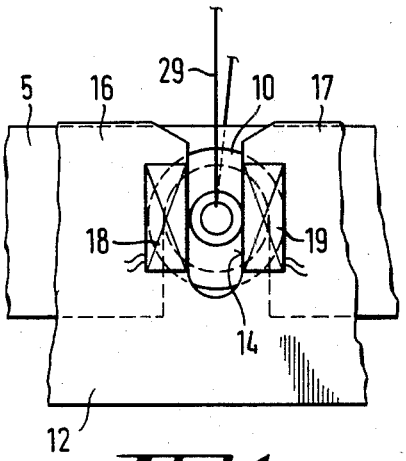
Fig. 4
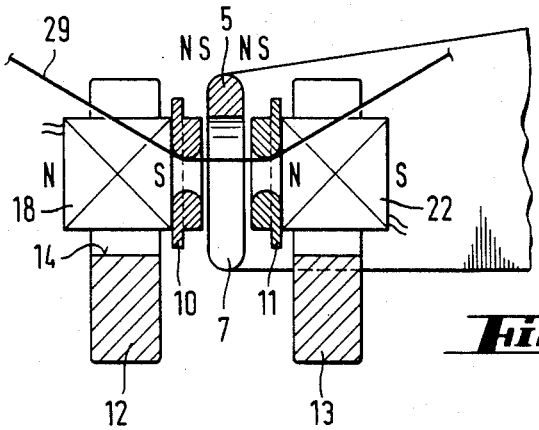
Fig. 3

Fig. 9
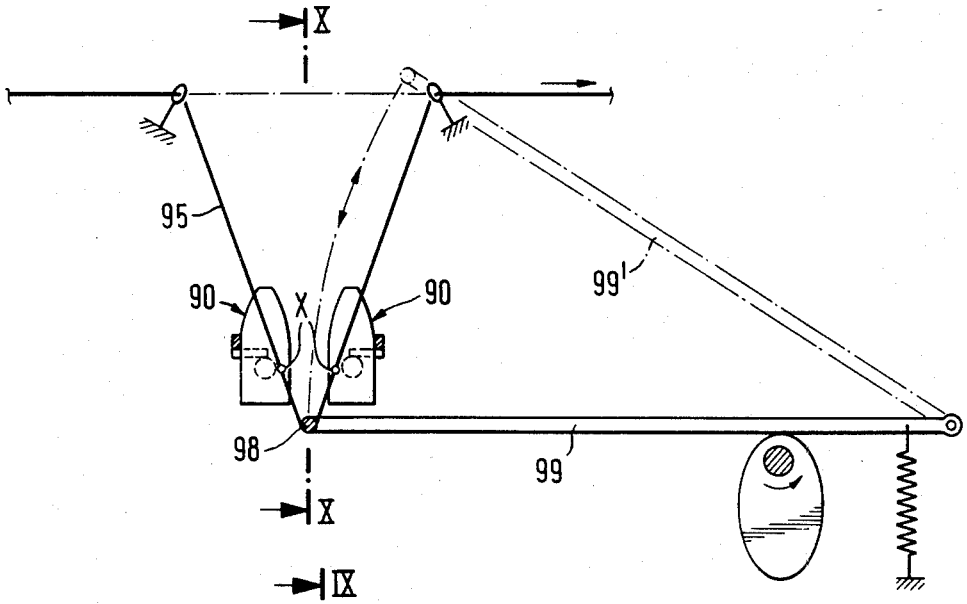
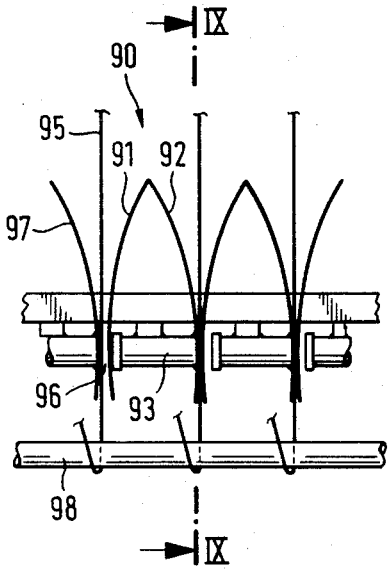
Fig. 10

WEFT YARN TENSIONING DEVICE

This invention relates to a weft yarn tensioning device. More particularly, this invention relates to a weft yarn tensioning device for weaving machines, particularly of the gripper projectile type.

As is known, weaving machines can be constructed to use a multiplicity of weft yarns. In such cases, the weaving machines have been provided with a weft yarn changing mechanism in order to select one or more of the weft yarns which are presented to the machine. Further, it has been known to provide a yarn tensioner for each weft yarn which is presented. However, one disadvantage of this construction is the need for an elaborate synchronous control of the movement of the individual tensioners.

Accordingly, it is an object of the invention to provide a weft yarn tensioning device which can tension all the weft yarns simultaneously and which can provide for an individual release of a weft yarn to be picked.

It is another object of the invention to provide a weft yarn tensioning device which can be readily incorporated into a weaving machine for a multiplicity of weft yarns.

It is another object of the invention to be able to individually select a weft yarn for picking in a weaving machne from a group of weft yarns.

Briefly, the invention provides a weft yarn tensioning device which comprises a rod, a plurality of retaining means and an actuating means which is connected to the plurality of retaining means.

The rod is disposed transversely of a row of weft yarns which is to be presented to a picking station of a weaving machine and is movable between a yarn deflecting position and a yarn releasing position. The retaining means are provided for retaining the weft yarns at the deflecting position while the actuating means is connected to the retaining means for selectively actuating each retaining means in order to retain a yarn in the deflecting position or release a yarn during movement of the rod to the releasing position.

In one embodiment, each retaining means of the tensioning device includes a pair of magnet rings which are coaxially mounted on the rod for guiding a yarn therethrough and at least a pair of electromagnets at the deflecting position. Upon actuation of a selected retaining means, the electromagnets thereof move the magnet rings from the rod by magnetic attraction. Thus, upon subsequent movement of the rod to the releasing position, the rings remain in the deflecting position and thus retain the yarn in this deflecting position. Upon deactuation of the retaining means, the electromagnets move the rings back onto the rod, for example, by a repelling action, when the rod is in the deflecting position. Thus, upon subsequent movement of the rod into the releasing position, the yarn can be positioned for picking.

In another embodiment, each retaining means of a tensioning device includes a pair of electromagnetic retaining elements disposed on opposite sides of the rod in the deflecting position. Each retaining element further includes a solenoid winding and a core which is movably mounted in the winding between an extended position and a retracted position. In the extended position, the core is able to retain a weft yarn in the deflecting position while in the retracted position, a gap is formed to permit a weft yarn to pass to the releasing position with the rod.

In still another embodiment, instead of using electromagnetic retaining elements of the core and solenoid type, each retaining element may include an electromagnet and a pair of flexible strips. In this case, one strip is secured to the electromagnet while the second strip faces the electromagnet for movement between an extended position and a retracted position. In the extended position, this second strip is spaced from the electromagnet and abuts an adjacent one of the retaining means in order to retain a weft yarn in the deflecting position. In the retracted position, the movable strip abuts the electromagnet and is spaced from the adjacent retaining means to form a gap to permit a weft yarn to pass to the releasing position with the rod.

In this latter embodiment, each pair of retaining elements, located astride the rod in the deflecting position, cooperates selectively retain a weft yarn in the deflecting position.

In still another embodiment, the tensioning device may be mechanically actuated. In this embodiment, the rod is formed with a U-shaped cross-section and each retaining means includes a hook for movement between an extended position within the rod in order to engage a weft yarn and a retracted position spaced from the rod to permit movement of the weft yarn. In addition, each retaining means may be provided with a pair of strips on each side of the rod in the deflecting position for guiding a weft yarn therebetween.

These and other objects and advantages of the invention will become more apparent from the following detailed description taken in conjunction with the accompanying drawings wherein:

FIG. 1 illustrates a perspective view of a weft yarn tensioning device according to the invention;

FIG. 2 ilustrates a view taken on line II—II of FIG. 1 of a retaining means constructed in accordance with the invention;

FIG. 3 illustrates a view similar to FIG. 2 with the retaining means in a position to deflect a weft yarn;

FIG. 4 illustrates a view taken in the direction of the arrows IV—IV of FIG. 2;

FIG. 9 illustrates a view taken on line IX—IX of FIG. 10 of a weft yarn tensioning device employing a modified electromagnetic construction in accordance with the invention;

FIG. 10 illustrates a view taken on line X—X of FIG. 9;

Figure 1:
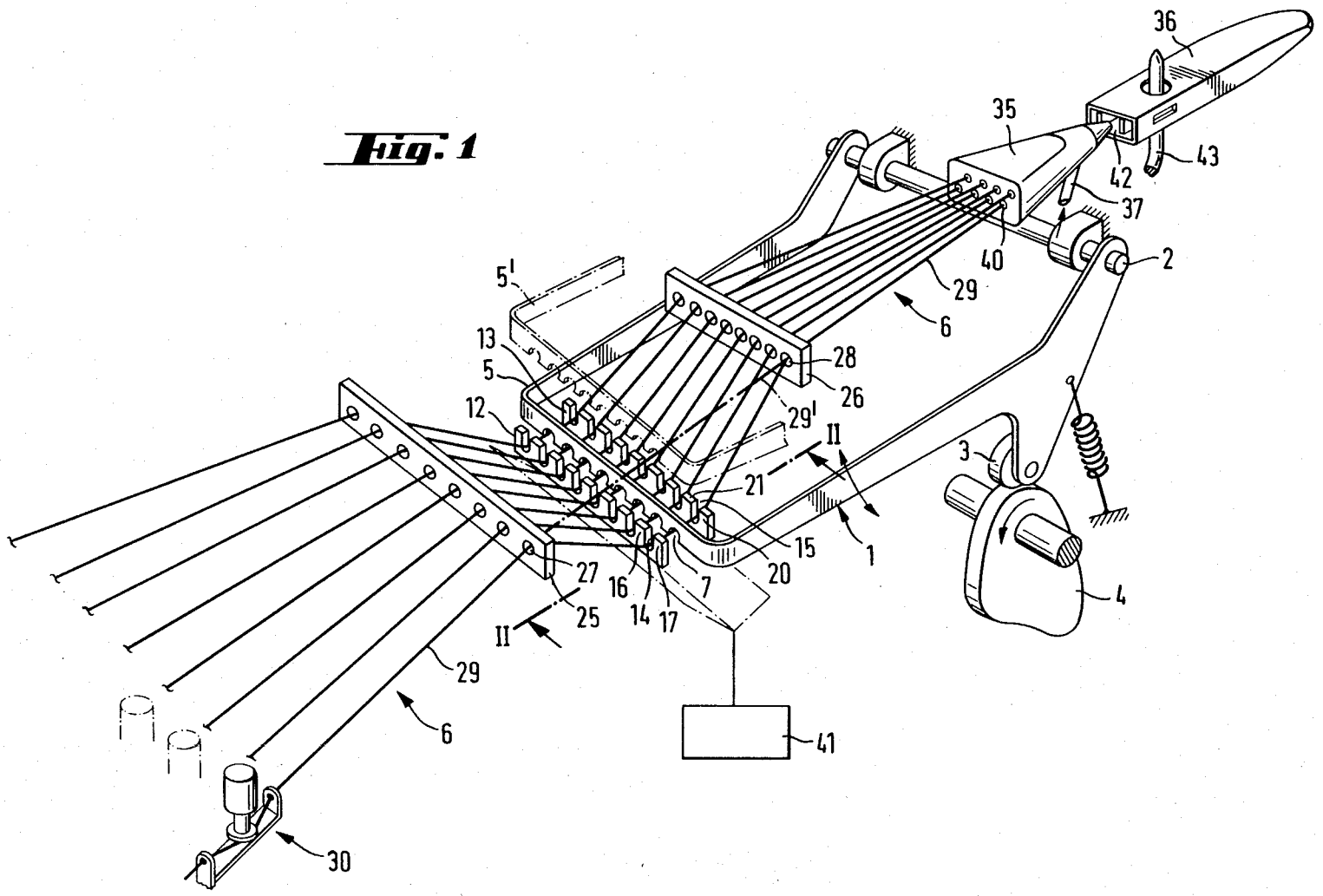

Referring to FIG. 1, a weaving machine (not shown) is provided with a weft yarn tensioning device having a yarn tensioner 1 in the form of a stirrup which is rotatable about a spindle 2. This tensioner 1 has a pair of arms to which a transverse member 5 in the form of a rod is connected in transverse manner relative to a plurality of parallel weft yarns 6. The tensioner 1 carries a roller 3 which cooperates with a means for moving the rod 5 between a yarn deflecting position, as shown in solid lines, and a yarn releasing position, as shown in dotted lines. This latter means includes a cam 4 which is driven by a main shaft of the weaving machine and which abuts the roller 3. Thus, the transverse rod 5 oscillates at the cadence of the machine transversely of the group of weft yarns 6.

As indicated in FIG. 1, the rod 5 is formed with a plurality of recesses 7, for example, eight for guiding the weft yarns 6 which are supplied from suitable supply bobbins (not shown).

Referring to FIGS. 1 and 2, the tensioning device is also provided with a plurality of retaining means for retaining the weft yarn 6 in the deflecting position. Each retaining means, as shown in FIG. 2, includes a pair of permanent magnet rings 10, 11 which are coaxially mounted in a respective recess 7 of the rod 5 for guiding a yarn 6 therethrough. As indicated, each ring 10, 11 is disposed on an opposite side of the recess and jointed together when retained on the rod 5. For the sake of clarity, these rings 10, 11 are not shown in FIG. 1.

Each of retaining means also includes a pair of carriers 12, 13 which are disposed to opposite sides of the rod 5 when in the deflecting position. Each of these carriers 12, 13 is formed with eight grooves 14, 15 and is disposed opposite a ring pair 10, 11. As shown in FIG. 4, a pair of electromagnets 18, 19 is disposed in the teeth or tines 16, 17 defining the grooves 14 of the carrier 12. In like manner, a pair of electromagnets 22 are disposed in the teeth 20, 21 defining the grooves 15 of the carrier 13. For the sake of clarity, the electromagnets 18, 19, 22 are omitted from FIG. 1.

Each electromagnet pair 18, 19 cooperates with the associated ring 10 to form an electromagnetic retaining element 23 for a weft yarn. A like retaining element 24 is disposed on the opposite side by the electromagnets 22 and guide ring 11.

Referring to FIG. 1, a pair of spaced apart carriers 25, 26 each having eight yarn rings 27, 28 are disposed on opposite sides of the rod 5 in order to guide the weft yarn 6. In addition, a yarn brake 30 is provided for each weft yarn 29 of the group of weft yarns 6. Only one yarn brake 30 is shown for clarity.

Still further, a weft yarn supplying device 35 is provided for inserting at least one of the weft yarns 6 into a projectile 36 for picking across a shed (not shown). As indicated, the yarn supplying device 35 has a discharge orifice which terminates in front of the projectile 36. In addition, the yarn supplying device 35 is supplied with compressed air through a line 37.

As indicated, each weft yarn, e.g., the yarn 29, after leaving a supply bobbin (not shown) passes through a yarn brake 30, ring 27, groove 14 in the carrier 12, rings 10, 11 on the rod 5, groove 15 in the carrier 13, ring 28, and a duct 40 in the yarn supplying device 35. The ends of all the weft yarns extend in the insertion device 35 substantially to the discharge orifice thereof. The position shown is assumed to be the initial position for the following description of the operation of the tensioning device. In this position, all the weft yarns have been deflected by the rod 5 and are retained in the deflecting position by the retaining elements 23, 24 and have been tensioned by the yarn supplying device 35. This is described hereinafter for one of the weft yarns.

Referring to FIG. 1, the tensioning device also includes an actuating means in the form of a control device 41 which is connected to the individual retaining means for selectively actuating each retaining means either to retain a yarn in the deflecting position or to permit release of a yarn during movement of the rod 5 to the releasing position.

Referring to FIG. 2, when the rod 5 has moved into the lowered deflecting position, one of the retaining means may be actuated by the control device 41 in order to release the previously selected yarn. For this, the electromagnet pair 18, 19 of the retaining element 23 on one side and the electromagnet pair 22 of the retaining element 24 on the other side of the rod 5 are polarized by the control device 41 to have the polarity shown in FIG. 3. Thus, the two permanent magnet rings 10, 11 are pulled over onto and adhered to the carriers 12, 13 (see FIG. 3). The retaining elements 23, 24 now retain the yarn 29 in the deflecting position. The other yarns are also retained in like manner by the associated retaining elements.

When a yarn is to be picked, the polarity of the selected electromagnets 18, 19, 22 is reversed. Hence, the two associated guide rings 10, 11 are repelled and engage with the rod 5 and with one another (see FIG. 2). The retaining elements 23, 24 of the selected retaining means are now open. With the subsequent rising of the rod 5 to the releasing position, the rings 10, 11 are carried thereby. Hence, the weft yarn 29 is free to be pulled into the position 29' (see FIG. 1) by the pull of the yarn supplying device 35.

During upward movement, the rod 5 moves freely past all the weft yarns which are not to be picked and rises into the releasing position 5'. During this time, the yarn supplying device 35 blows the end of the selected weft yarn 29 into a yarn clamp 42 in the projectile 36. This is after an opener 43 has opened the yarn clamp 42. The following operation of the weaving machine is known and need only be briefly described.

After withdrawing the opener 43 so that the yarn clamp 42 closes on the leading end of the yarn 29, the yarn brake 30 opens. Immediately afterwards, the projectile 36 is picked by the associated picking mechanism (not shown) so that the necessary length of weft yarn is drawn off the supply bobbin (not shown) and picked into the shed. After the projectile 36 has carried the weft yarn through the shed, the projectile is braked in a catcher (or receiver) and then pushed back. Simultaneously, the yarn tensioner 7 descends to keep the weft yarn stretched. An edge yarn clamp on both sides of the shed also takes over the weft yarn. The yarn is then severed on the picking side, for example by scissors, and is released on the catcher side from the projectile by opening of the yarn clamp. The yarn can then be beaten up by a reed.

As the yarn tensioner 1 continues to descend, the picked yarn is deflected and pulled back until the severed end is disposed in the exit of the yarn supplying device 35. Once the yarn tensioner 1 has arrived at the deflecting position, the polarity of the electromagnets 18, 19, 22 is changed over again so as to attract the rings 10, 11. After engaging with the carriers 12, 13, the rings 10, 11 retain the yarn 29 in the deflected position.

If the left yarn 29 has to be picked a second or further time, the electromagnets 18, 19, 22 can, during such second picking, remain of the same polarity so that the associated retaining elements do not close. That is, there is no need to retain the yarn which is being picked in the deflecting position.

Of note, a conveyer may be provided to receive the projectile which has been ejected from the catcher for conveyance outside of the shed back to the picking station. The projectile 36 can then be opened by the opener 43 and simultaneously rotated by a projectile feeder (not shown) before the yarn supplying device 35 in readiness to receive the next weft yarn. The position is then as shown in FIG. 1.

Figure 5:
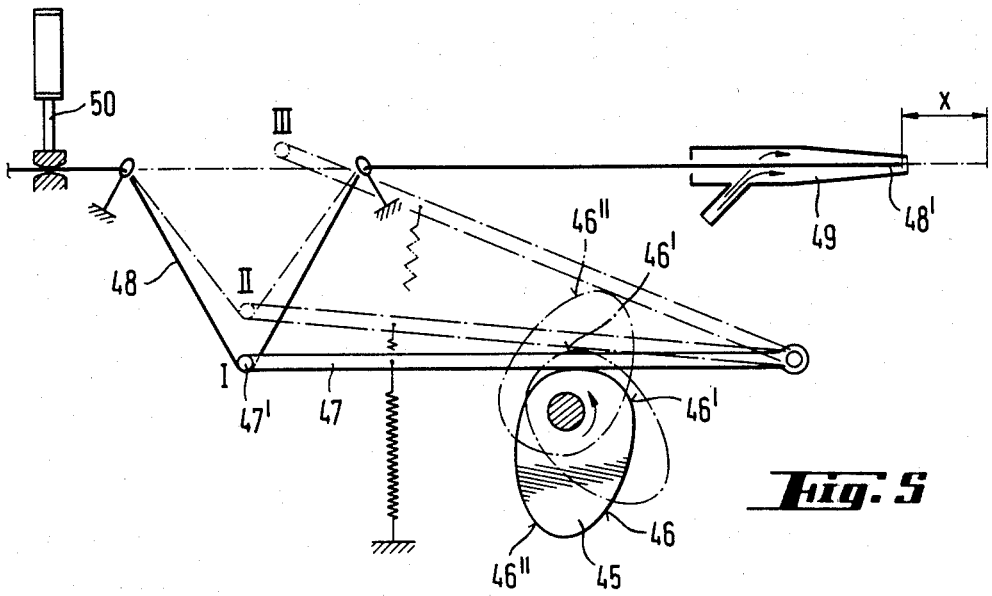
FIG. 5 illustrates a schematic view of a means for moving the rod of a yarn tensioning device in accordance with the invention.

Referring to FIG. 5, the rising movement, i.e. the releasing movement, of the yarn tensioner 1 proceeds in two phases. In the first phase, the weft yarn end is transferred to the projectile 36 while in a following second phase, the weft yarn is released for picking. In this regard, the cam 45 is used for moving the rod between the deflecting and releasing position. This cam 45 has a camming surface 46 formed by one portion 46 for initially moving the yarn tensioner 47 from the deflecting position I into an intermediate position II at a relatively slow speed. Thus, the transverse member or rod 47' of the tensioner remains in contact with the weft yarn 48 to be picked while the yarn is tensioned by the yarn supplying device 49. Consequently, a weft yarn end 48' of a length x is transferred relatively slowly to the projectile (not shown). This makes transfer more reliable. A following second portion 46'' of the cam surface 46 then comes into operation with the effect that the yarn tensioner 47 is accelerated to a relatively fast speed from the intermediate position II into the end of releasing position III. During this time, the tensioner rod 47' is completely free of the weft yarn 48. As a result, the weft yarn 48 can be pulled rapidly and clear of the rod 47 when pulled by the projectile (not shown) with the brake 50 off and picked into a shed.

Figure 6:
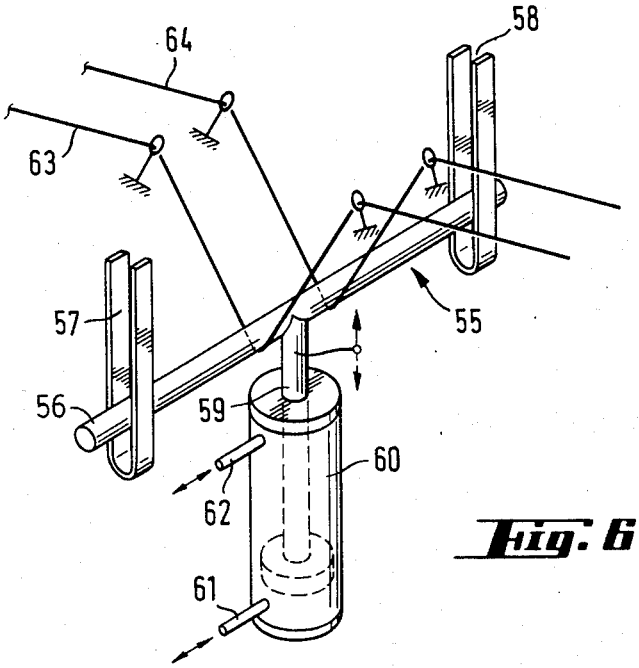
FIG. 6 illustrates a modified means of moving a rod of a weft yarn tensioning device in accordance with the invention.

Referring to FIG. 6 the tensioner may alternatively employ a rod 56 which is guided within two grooves 57, 58 formed by suitable U-shaped brackets. In addition, the rod 56 is oscillated by piston rod 59 of a pneumatic or hydraulic actuating cylinder 60 to which pressure medium is applied alternately through a pair of connections 61, 62. As indicated, weft yarns 63, 64 extend below the rod 56 and are kept stretched by a weft yarn supplying device (not shown). For the sake of clarity, the retaining elements for retaining the weft yarns which are not to be picked in the deflected position have been omitted from FIG. 6.

Figure 7:
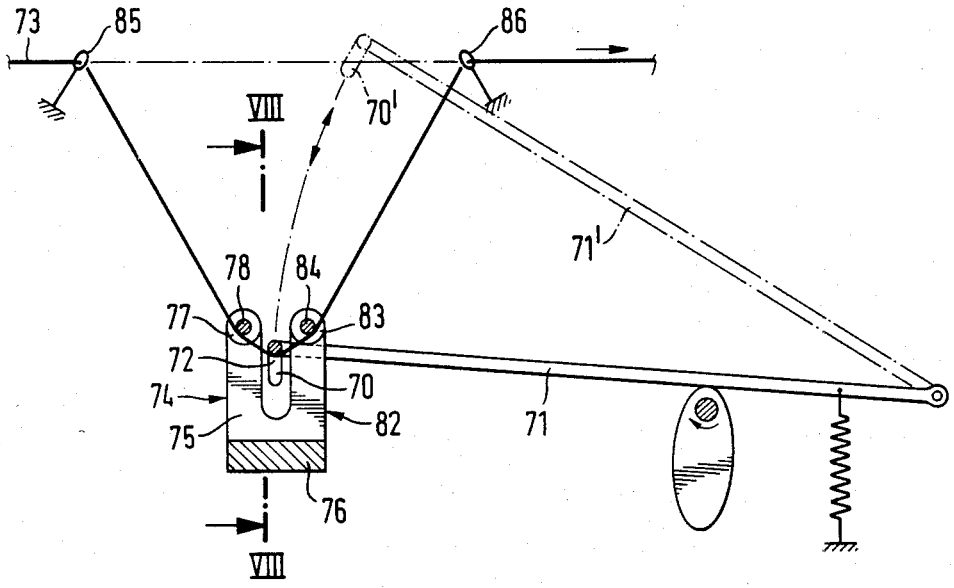
FIG. 7 illustrates a view taken on line VII—VII of FIG. 8 of a modified weft yarn tensioning device employing electromagnets of the solenoid type in accordance with the invention.
Figure 8:
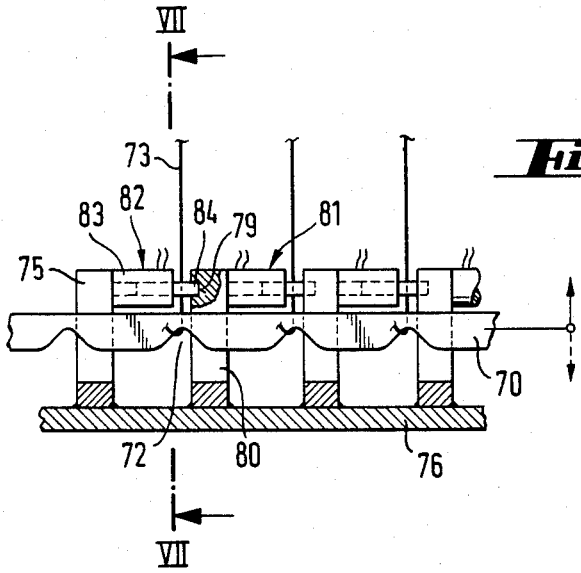
FIG. 8 illustrates a view taken on line VIII—VIII of FIG. 7.

Referring to FIGS. 7 and 8, the yarn tensioning device may be made of a further alternative constructions. For example, as illustrated, a transverse member or rod 70 of the yarn tensioner 71 may be formed with a plurality of yarn-guiding recesses 72, each of which guides a weft yarn 73. In addition, an electromagnetic retaining element 74 which is secured to a support 75 is disposed before each recess 72 when the rod 70 is in the lowered deflecting position. As indicated, the support 75 is supported on a carrier 76 which extends transversely of the weft yarn group. Each retaining element 74 comprises a solenoid winding 77 and a core 78 which is movably mounted in the solenoid winding between an extended position and a retracted position. When the winding 77 is in a deenergized state, the core 78 is received in an aperture 79 in a support 80 of an adjacent retaining element 81 (see FIG. 8). When in the extended position, the core 78 is able to retain a weft yarn in the deflective position. In the retracted position, the core 78 leaves a gap through which the weft yarn may pass to the releasing position.

The carrier 76 carries a similar arrangement of retaining elements on the other side of the transverse rod 70. Thus, a retaining element 82 comprising a solenoid winding 83 and an associated moving core 84 is disposed opposite the retaining element 74.

As indicated in FIG. 7, a deflected weft yarn 73 passing from a supply bobbin (not shown) passes through a yarn brake (not shown), a ring 85, to the underside of the solenoid core 78, through a recess 72 of the rod 70, below the solenoid core 84 of the retaining element 82 and through a yarn guiding ring 86 to a weft yarn supplying device (not shown).

The operation of the tensioning device is similar to that as described above with respect to FIG. 1. To this end, if a weft yarn 73 is to be picked, the two solenoid windings 77, 83 are energized so that the cores 78, 84 are retracted. The weft yarn 73, together with the rod 70 which is oscillating upwards into the position 71' (i.e. the releasing position), can then move up and be stretched and the yarn end transferred from the yarn supplying device (not shown) to a projectile (not shown). During this time, the retaining elements associated with the weft yarns which are not to be picked remain closed.

In a subsequent descent, the rod 70 moves down with the weft yarn 73 and pushes the yarn 73 below the cores 78, 84 which are retracted at this time. The windings 77, 83 are then switched off so that the cores 78, 84 are forced out under the bias of a spring (not shown) to retain the yarn 73 in the retracted position as indicated in FIG. 7.

Referring to FIGS. 9 and 10, the weft yarn tensioner may be provided with modified retaining elements from those as described in FIGS. 7 and 8. As indicated in FIG. 9, the retaining means for the weft yarns includes a pair of electromagnetic retaining elements 90 on opposite sides of the transverse rod 98 of the yarn tensioner 99. Each of these retaining elements 90 comprise a pair of flexible strips or reeds 91, 92 and an electromagnet 93 therebetween. As indicated in FIG. 10, one strip 92 is secured to the electromagnet 93 while the second strips 91 faces the electromagnet for movement between an extended position spaced from the electromagnet 93 and abutting the adjacent retaining means and a retracted position (as shown) abutting the electromagnet 93 and spaced from the adjacent retaining means. When the electromagnet 93 is in a de-energized state, the resilient strips of adjacent elements press on one another so that no gap is left therebetween. In this case, the strips contact each other over a contact zone x as indicated in FIG. 9. When the electromagnet 93 is energized, the strips are spaced apart so that a gap 96 is formed between, e.g., the movable strip 91 of one retaining element and the stationary strip 97 of the next adjacent retaining element. Thus, a weft yarn 95 is able to pass through the gap.

When the transverse rod 98 oscillates upwardly, the weft yarn 95 can yield to the pull of the yarn supplying device (not shown) so that the yarn 95 is tensioned and the leading end introduced into a projectile and picked thereby. After picking, the weft yarn is moved down by the descending transverse rod 98 to a point within or behind the contact zones x of the two strips 91, 97. Thereafter, the electromagnet 93 is de-energized so that the weft yarn is again clamped.

Of note, the operation of the various retaining elements is such that each associated pair of retaining elements 90 is energized or de-energized simultaneously for the retention or release of a weft yarn.

Figure 11:
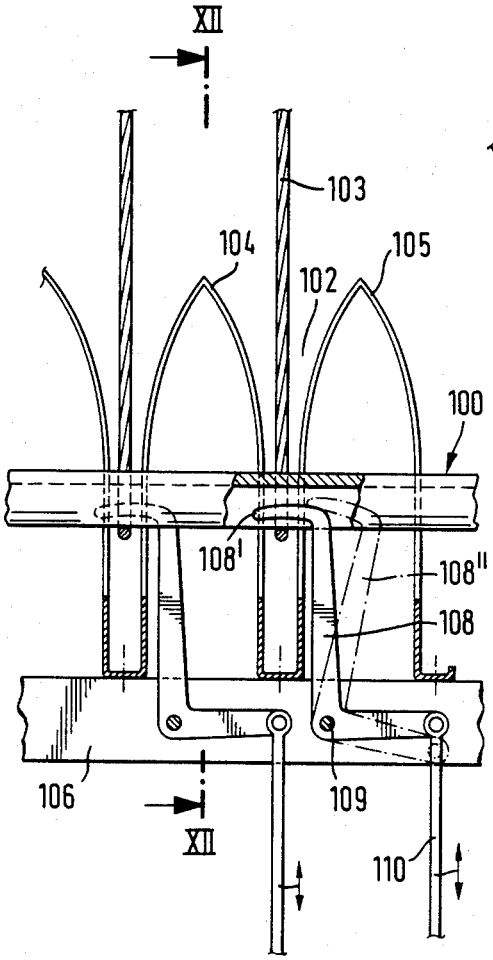
FIG. 11 illustrates a view taken on line XI—XI of FIG. 12 of a weft yarn tensioning device of mechanical type in accordance with the invention.
Figure 12:
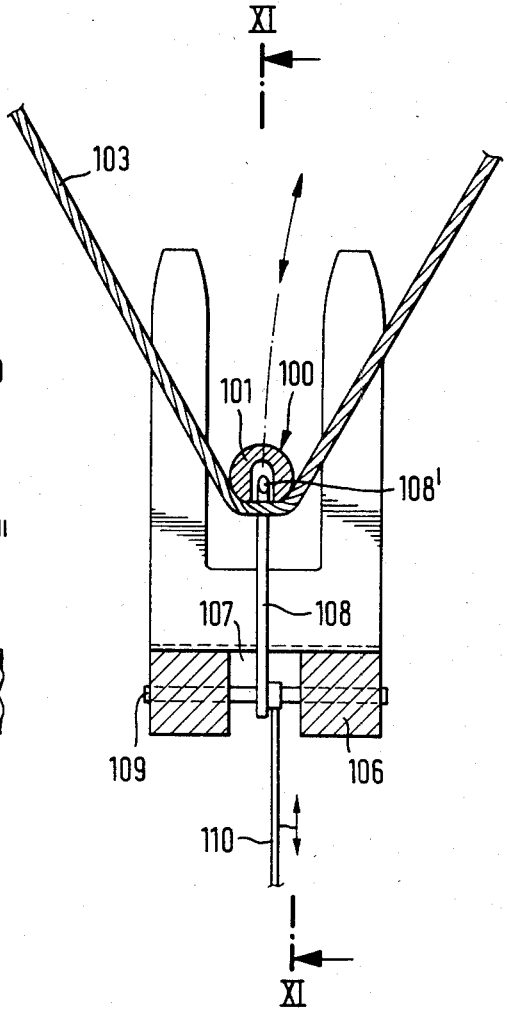
FIG. 12 illustrates a view taken on line XII—XII of FIG. 11.

Referring to FIGS. 11 and 12, the retaining means may be constructed of mechanically actuated parts. To this end, the yarn tensioner has a transverse rod 100 of channel-shaped cross-section 101. In addition, yarn guides are provided on each side of the transverse rod 100 for guiding the respective yarns. For example, a pair of yarn guides are formed on opposite sides of the rod 100 by pairs of strips or reeds 104, 105 which are formed on a common bridging member (see FIG. 12) which, in turn, is secured to a carrier 106. As indicated in FIG. 11, each pair of strips 104, 105 forms a finger-like guide 102 for a weft yarn 103.

The retaining means also includes a hook 108 for movement between an forwardly extended position within the rod 100 when in the deflecting position in order to engage a weft yarn 103 and a retracted position (108″) spaced from the yarn 103.

Each hook 108 is in the form of a toggle which is located within a groove 107 of the carrier 106 and is pivotal about a spindle 109. In addition, a pull rod 110 which is actuated off the main shaft of the weaving machine in accordance with the weaving pattern is pivoted to the toggle hook 108. As shown in FIG. 11, the free end 108′ of the hook 108 extends into the rod 100 and is hooked behind the weft yarn 103 in order to prevent the yarn 103 from being stretched by the pull of the yarn supplying device (not shown). However, when the yarn is to be picked, the hook 108 is rotated to the right, as viewed, into the retracted position 108″ so that the hook 108 permits the weft yarn 103 to rise simultaneously with the rod 100 for transfer to a projectile for picking.

Although the weft yarn tensioning device is described with respect to a weft yarn supplying device of the air nozzle type as the means for transferring the weft yarns to a gripper projectile, the tensioning device may be used with any suitable mechanical transfer facility.

Further, the tensioning device may be used with other types of weaving machines having other forms of picking elements than a gripper projectile.

The invention thus provides a tensioning device for a group of weft yarns which is able to operate in a reliable manner while providing for an individual release of a weft yarn for picking.

What is claimed is:

1. A weft yarn tensioning device for a weaving machine, said device comprising a rod of U-shaped transverse cross-section for disposition transversely of a row of weft yarns and movable between a yarn deflecting position and a yarn releasing position;

a plurality of retaining means for retaining the weft yarns at said deflecting position, each retaining means including a hook for movement between an extended position within said rod to engage a weft yarn and a retracted position spaced from the yarn; and an activating means connected to said plurality of retaining means for selectively actuating each said retaining means to retain a selected yarn in said deflecting position and to release a selected yarn during movement of said rod to said releasing position.

2. A weft yarn tensioning device according to claim 1 wherein each retaining means includes a pair of spring strips on each side of said rod in said deflecting position for guiding a weft yarn therebetween.

3. A weft yarn tensioning device according to claim 1 wherein said rod is incorporated in a stirrup having a pair of arms mounting said rod therebetween.

4. A weft yarn tensioning device according to claim 3 wherein said arms are transverse to said rod for pivoting parallel to the row of weft yarns.

5. A weft yarn tensioning device according to claim 1 which further comprises a rotatable cam for moving said rod between said positions, said cam having a first portion for initially moving said rod from said deflecting position towards said releasing position at a relatively slow speed and a following second portion for accelerating said rod to a relatively fast speed into said releasing position.

6. In a weaving machine, the combination comprising a weft yarn insertion device for inserting at least one weft yarn into a projectile for picking across a shed;

a pair of spaced apart carriers for guiding a plurality of weft yarns in parallel relation into said insertion device;

a rod of U-shaped transverse cross-section disposed across the weft yarns between said carriers;

means for moving said rod between a yarn deflecting position and a yarn releasing position;

a plurality of retaining means for retaining the weft yarns at said deflecting position, each retaining means including a hook for movement between an extended position within said rod to engage a weft yarn and a retracted position spaced from the yarn; and an actuating means connected to said plurality of retaining means for selectively actuating each said retaining means to retain a selected yarn in said deflecting position and to release a selected yarn during movement of said rod to said releasing position.

7. The combination as set forth in claim 6 wherein said means for moving said rod includes a rotatable cam for moving said rod between said positions, said cam having a first portion for initially moving said rod from said deflecting position towards said releasing position at a relatively slow speed to permit transfer of a yarn end to a projectile relatively slowly and a following second portion for accelerating said rod to a relatively fast speed into said releasing position for picking of a yarn into the shed.

8. The combination as set forth in claim 6 which further comprises spring strips on opposite sides of said rod for guiding the weft yarns.

9. In a weaving machine, the combination comprising a weft yarn insertion device for inserting at least one weft yarn into a projectile for picking across a shed;

a pair of spaced apart carriers for guiding a plurality of weft yarns in parallel relation into said insertion device;

a rod disposed across the weft yarns between said carriers and including a plurality of recesses for receiving the weft yarns;

means for moving said rod between a yarn deflecting position and a yarn releasing position;

a plurality of retaining means for retaining the weft yarns at said deflecting position, each retaining means including a pair of rings disposed in a respective recess of said rod for guiding a weft yarn therethrough and a pair of electromagnets on each side of said rod at said deflecting position for selectively moving a respective ring from and to said rod; and an actuating means connected to said plurality of retaining means for selectively actuating each said retaining means to retain said electromagnets thereof and a selected yarn in said deflecting position and to release said electromagnets thereof and a selected yarn during movement of said rod to said releasing position.

10. In a weaving machine, the combination comprising a weft yarn insertion device for inserting at least one weft yarn into a projectile for picking across a shed;

a pair of spaced apart carriers for guiding a plurality of weft yarns in parallel relation into said insertion device;

a rod disposed across the weft yarns between said carriers;

means for moving said rod between a yarn deflecting position and a yarn releasing position;

a plurality of retaining means for retaining the weft yarns at said deflecting position, each retaining means including a pair of electromagnetic retaining elements disposed on opposite sides of said rod in said deflecting position, each retaining element including a solenoid winding and a core movably mounted in said solenoid between an extended position to retain a weft yarn in said deflecting position and a retracted position to permit a weft yarn to pass to said releasing position with said rod; and an actuating means connected to said plurality of retaining means for selectively actuating each said retaining means for selectively actuating each said retaining means to retain a selected yarn in said deflecting position and to release a selected yarn during movement of said rod to said releasing position.

* * * * *